United States Patent [19]

Breveglieri

[11] Patent Number: 4,962,573

[45] Date of Patent: Oct. 16, 1990

[54] CLASP FOR RETAINING CONTAINERS

[75] Inventor: Frank L. Breveglieri, Spring Lake, Mich.

[73] Assignee: Geerpres, Inc., Muskegon, Mich.

[21] Appl. No.: 422,739

[22] Filed: Oct. 17, 1989

[51] Int. Cl.[5] ..... A44B 1/38

[52] U.S. Cl. ..... 24/573.1; 24/108

[58] Field of Search ..... 24/573, 572, 30.5 P, 24/17 AP, 104, 108, 706, 706.1, DIG. 29, 704.2; 220/85 H, 404; 150/129

[56] References Cited

U.S. PATENT DOCUMENTS

| | | | |
|---|---|---|---|
| 1,198,567 | 9/1916 | Morley . | |
| 1,368,878 | 2/1921 | Bandell | 24/108 |
| 1,653,556 | 12/1927 | Faber . | |
| 1,751,707 | 3/1930 | Nash | 24/104 |
| 1,869,756 | 8/1932 | Kinard . | |
| 2,501,463 | 3/1950 | Babaian | 150/3 |
| 2,658,249 | 11/1953 | Wilson | 24/108 |
| 2,818,871 | 1/1958 | Beaudry | 132/48 |
| 2,937,834 | 5/1960 | Orenick et al. | 24/573 |
| 3,135,820 | 6/1964 | Hallett, Jr. et al. | 174/5 |
| 3,144,695 | 8/1964 | Budwig | 24/573 |
| 3,210,820 | 10/1965 | Humiston | 24/625 |
| 3,256,919 | 6/1966 | Ogletree | 150/1 |
| 3,416,200 | 12/1968 | Daddona, Jr. | 24/208 |
| 3,561,074 | 2/1971 | Mosher, Jr. et al. | 24/573 |
| 3,831,650 | 8/1974 | Consorti | 150/7 |
| 3,943,988 | 3/1976 | Consorti | 150/7 |
| 3,967,666 | 7/1976 | Farrar | 150/1 |
| 4,054,225 | 10/1977 | Frech | 220/63 R |
| 4,054,226 | 10/1977 | Bjelland et al. | 220/63 R |
| 4,083,392 | 4/1978 | Kobayashi | 150/51 |
| 4,235,350 | 11/1980 | Valentino | 220/404 |
| 4,259,973 | 12/1979 | Seiller | 132/48 R |
| 4,356,933 | 11/1982 | Connolly | 220/401 |
| 4,441,233 | 4/1984 | Swift | 24/16 PB |
| 4,457,050 | 7/1984 | Kanbaka | 24/108 |
| 4,493,358 | 1/1985 | Jacobson | 160/349 R |
| 4,724,791 | 2/1988 | McSorley | 114/343 |
| 4,777,704 | 10/1988 | Acker | 24/108 |
| 4,777,705 | 10/1988 | Ingram | 24/573 |
| 4,783,031 | 11/1988 | Ebentheuer | 248/97 |

*Primary Examiner*—Victor N. Sakran

*Attorney, Agent, or Firm*—Harness, Dickey & Pierce

[57] ABSTRACT

The present invention relates to a reusable clasp for retaining a container. The reusable clasp includes a first and a second member, the first member having a stud projecting therefrom, and a ball at an end thereof for locking with an annular space in the second member. The reusable clasp can be folded about an edge of the container to be retained and the first member is forced through the container and interlocked with the second member thereafter retaining the container.

8 Claims, 1 Drawing Sheet

CLASP FOR RETAINING CONTAINERS

BACKGROUND OF THE INVENTION

The present invention relates to clasps for retaining containers. More particularly, the present invention relates to clasps for retaining disposable containers.

TECHNICAL FIELD

The present invention is directed toward a reusable clasp for retaining containers. Moreover, the present invention is particularly useful for retaining containers used in industrial cleaning. Specifically, the present invention is beneficial for use with hospital cleaning.

Various techniques have been disclosed in the patent literature for covering or retaining objects. For example, U.S. Pat. No. 1,994,001 (Lobel) discloses a handbag cover.

U.S. Pat. No. 2,311,847 (Long) discloses a removable liner for use with a lady's pocketbook. More particularly, Long's liner is useful for concealing the innerwalls of a lady's handbag.

U.S. Pat. No. 2,952,956 (Mitchko) teaches a device for securing a coin bag, such as used in the banking industry. Specifically, the Mitchko device is used to insure the integrity of money contained within the bag.

U.S. Pat. No. 3,041,743 (Monsma) discloses an apparatus for separating and retaining children's footwear.

U.S. Pat. No. 3,161,929 (Swett) discloses a holder of sheet material and the like. More specifically, the Swett device is used for retaining towels.

U.S. Pat. No. 3,346,927 (Tompkins) teaches a detachable retainer for retaining articles wherein the articles are primarily apparel.

U.S. Pat. No. 4,047,651 (McMullen) discloses a band for retaining a watch. Moreover, the McMullen device includes a snap and a Velcro patch.

U.S. Pat. No. 4,235,350 (Valentino) discloses a container for waste hanging on a bedside rail. Further, the Valentino container is suspended from the bedside rail via a pair of straps.

U.S. Pat. No. 4,280,258 (Kunze) teaches a cable sleeve having a closable longitudinal slit therein for receiving a bead coacting therewith.

U.S. Pat. No. 1,198,567 (Morley) discloses a retainer for holding overshoes in place by attaching the overshoe to the heel of the shoe.

U.S. Pat. No. 2,818,871 (Beaudry) teaches a semi-flexible hair barrette. More particularly, the Beaudry apparatus has gripper elements for gripping hair.

U.S. Pat. No. 3,416,200 (Daddona) teaches a permanently locking one piece snap fastener composed of a plastic material. In short, the Daddona device is particularly useful on hospital identification bracelets and is not reusable.

U.S. Pat. No. 3,135,820 (Hallett) is directed toward fastening devices for linemen's blankets.

U.S. Pat. No. 4,441,233 (Swift) discloses a plastic security seal. More specifically, the Swift apparatus is formed from a single piece of molded plastic.

U.S. Pat. No. 4,493,358 (Jacobson) teaches a puncture and snap device for retaining pleats in draperies.

U.S. Pat. No. 4,259,973 (Seiller) discloses a retaining member for a spring clip having a unitary body.

None of these prior approaches can be used for retaining a container, such as a trash receptacle used in industrial cleaning. Moreover, none of the aforenoted prior approaches teaches the use of a two member reusable clasp for securing and retaining a disposable trash container.

SUMMARY OF THE INVENTION

A primary object of the present invention is to provide a clasp for retaining a container.

It is another object of the present invention to provide a reusable clasp for retaining a container.

It is still another object of the present invention to provide a flexible two member clasp for retaining and securing a container such as a disposable trash receptacle.

It is yet another object of the present invention to provide a flexible and reusable clasp which is economically manufactured.

It is yet still another object of the present invention to provide a reusable clasp which is already adapted for use with industrial cleaning carts. Moreover, is a specific object of the present invention to provide a reusable clasp for use in conjunction with commercially available hospital sanitation carts.

It is a further object of the present invention to provide a reusable clasp for retaining a container such as a trash receptacle which provides sufficient gripping forces for maintaining the trash receptacle's integrity thus insuring the trash receptacle does not tear away from the reusable clasp.

More particularly, it is still another object of the present invention to provide a clasp which can be used with paper or plastic trash receptacles.

Pursuant to the present invention, the reusable clasp includes a first member having a stud projecting therefrom and a second member including two rings for reciprocating and locking with the first member. Additionally, the second member includes a first and a second ring attached via a flexible connector. The stud includes a ball at one end for reciprocating and locking with an annular space on the second ring. Moreover, the first ring has an opening for allowing the stud to pass therethrough.

The second member can then be folded about an edge of the container, such as a trash receptacle, to be retained. The stud of the first member is thereafter forced through the first ring and the container. The ball of the stud is then interlocked with the annular space of the second ring thereby retaining the container in place. Further, the second member can be provided with a tab for releasing the reusable clamp.

The reusable clasp of the present invention is particularly useful for retaining disposable containers composed of paper or plastic.

Further, the reusable clasp of the present invention has been found to be beneficial for use in industrial cleaning and more particularly for use in hospital cleaning in conjunction with a hospital cleaning cart.

Within the scope of the present invention, it has been determined that the reusable clasp performs its intended function proficiently when the clasp is manufactured of plastic material. It has unexpectedly been determined that polyethylene provides both sufficient rigidity and flexibility in accordance with the present invention.

Furthermore and within the scope of the present invention the first and second members can be provided with recesses for reciprocating with projections or bases of the first and second members.

Additionally and in accordance with the present invention, the recess of the second ring can be provided with a ridge for gripping the container to be retained.

Finally, within the scope of the present invention, the stud can be provided with a lip for interlocking with the opening of the second member.

DETAILED DESCRIPTION OF THE INVENTION

Although the disclosure hereof is detailed to enable those skilled in the art to practice the invention, the embodiment(s) disclosed herein merely exemplify the present invention which may be embodied in other specific structures. The scope of the present invention is defined by the claims appended hereto.

Figure 1:
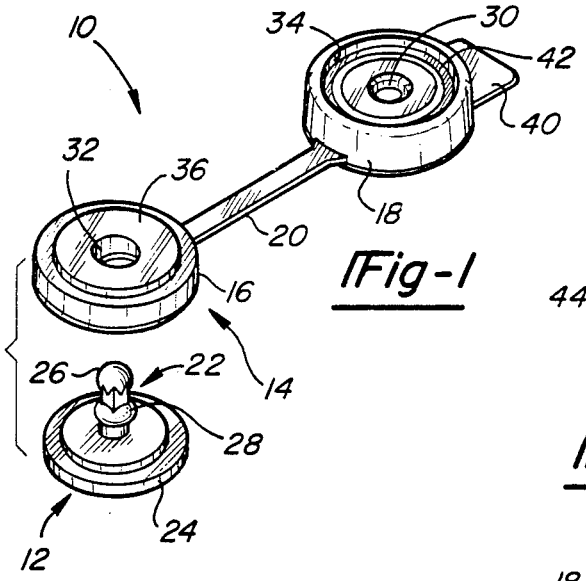
FIG. 1 is a perspective view of a clasp in accordance with the present invention.
Figure 6:
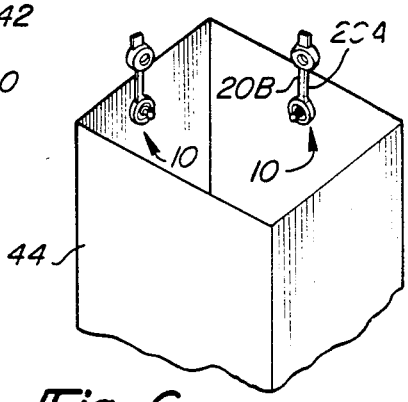
FIG. 6 is a perspective view of clasps in accordance with the present invention on a support surface.
Figure 2:
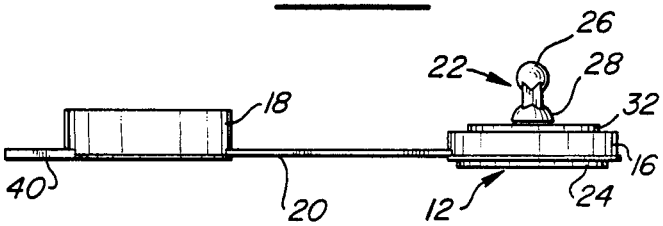
FIG. 2 is a side elevation view of the clasp of FIG. 1 with the first and second members joined together.
Figure 3:
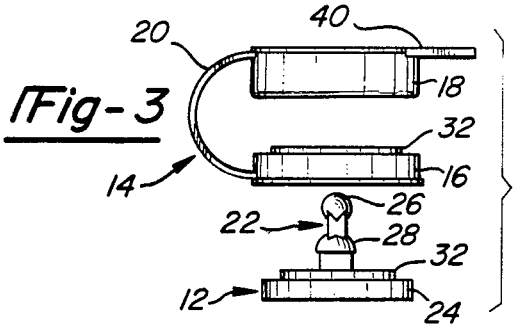
FIG. 3 is a side elevation view of the clasp of FIG. 1 in a disjoined position.
Figure 4:
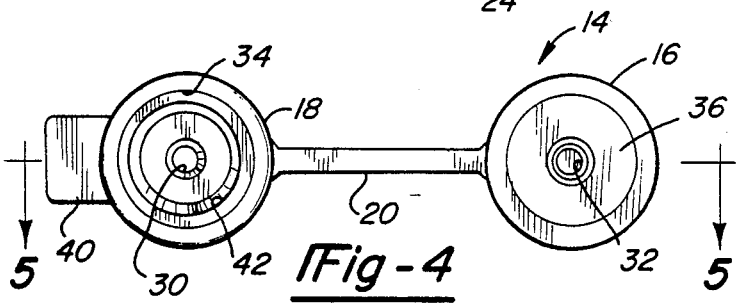
FIG. 4 is a plan view of the second member of the clasp of FIG. 1.
Figure 5:
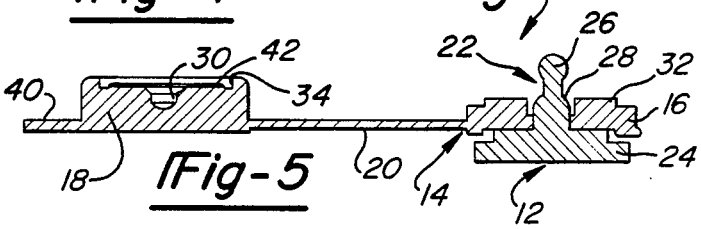
FIG. 5 is a sectional view through the line 5-5 of FIG. 4.

Turning to FIG. 1, reusable clasp 10 is provided with first member 12 and second member 14. Second member 14 includes first ring 16 attached to second ring 18 via connector 20. Connector 20 is manufactured from flexible material such as plastic and more specifically polyethylene terephthalate. In still another embodiment of the present invention, first ring 16 and second ring 18 can be attached via connectors 20A and 20B. Connectors 20A and 20B are manufactured from materials identical to those materials used in the manufacture of connector 20.

First member 12 is provided with stud 22 projecting from annular base 24 for stud 22 found on first member 12. Additionally, stud 24 includes ball 26 at stud 24's end opposite annular base 24. Further, stud 24 can be provided with lip 28 for interlocking with an opening (to be described more fully hereinafter) of second member 14.

As previously identified, second member 14 includes first ring 16 and second ring 18. Second ring 18 is provided with annular space 30 for reciprocating and locking with ball 26.

First ring 16 includes opening 32 for allowing stud 22 to pass therethrough. Lip 28 of stud 22 can interlock with opening 32 of second member 14.

In accordance with the present invention, second ring 28 can be provided with recess 34 for receiving and reciprocating with projection 36 of first ring 16. In a more preferred embodiment of the present invention both recess 34 and projection 36 are annular.

Within the scope of the present invention, first ring 16 can be provided with recess 38 on first ring 16's side opposite first ring 16's projection for receiving and reciprocating with annular base 24 of first member 12.

Further, second ring 18 includes tab 40 for use when releasing the reusable clasp of the present invention is desired. Additionally, second ring 18 can be provided with annular ridge 42 for providing additional gripping forces to the container to be retained when reusable clasp 10 is being used.

By way of demonstration only, the present invention can be practiced as indicated below. Second member 14 is placed about a support 44. Support 44 can include a rail of an industrial cleaning cart or any other surface that will anchor reusable clasp 10. An edge of the container (not shown) to be retained is placed between first ring 16 and second ring 18 of second member 14. First ring 16 and second ring 18 are folded about the container's edge until first ring 16 and second ring 18 are in proximal contact with each other. Stud 22 of first member 12 is then forced through opening 32 of first ring 16 and through the container to be retained. Ball 26 of stud 22 reciprocates and locks with annular space 30 of second ring 18 thereby retaining the container. Tab 40 of second member 14 can be utilized when releasing reusable clasp 10 is desired.

As has been previously indicated, the present invention is particularly useful when disposable containers used in industrial cleaning are to be retained. More particularly, the present invention has demonstrated great success when the containers to be retained are composed of paper or plastic materials.

Having set forth the description of their invention, Applicants now turn to the claims directed to their invention. It being reiterated that the claims appended hereto define the scope of Applicants' invention.

What is claimed is:

1. A reusable clasp for retaining a disposable flexible container mounted on a supporting surface, comprising:

a first male member having a base and a stud projecting therefrom, said first male member to be removably attached to the support surface such that said stud extends from said surface, said stud including an end freely extending from said first male member;

a ball formed on the free extending end of said stud, and a groove retainer member on said stud positioned adjacent said base;

a second female member having a first ring member and a second ring member, said first ring member having an opening for removably securing said first ring member with said groove retainer member on said stud such that the support surface is sandwiched between said base of said first male member and said first ring member and enabling the free extending end of said stud to pass through said first ring member, said second ring member having a socket member for removably receiving said ball on said stud for removably locking said second ring member with said ball; and a flexible member integrally connecting said first and second ring members for enabling said second ring member to move relative to said first member for removably securing to said ball.

2. The reusable clasp of claim 1 for retaining said container wherein said container is comprised of paper.

3. The reusable clasp of claim 1 for retaining said container wherein said container is comprised of plastic.

4. The reusable clasp of claim 1 wherein said clasp is comprised of polyethylene.

5. The reusable clasp of claim 1 wherein said second ring further includes a tab therefrom for releasing said reusable clasp.

6. The reusable clasp of claim 1 wherein said second ring further includes a recess for receiving a projection on said first ring.

7. The reusable clasp of claim 6 further including an annular ridge on said recess for providing additional gripping of said container.

8. The reusable clasp of claim 1 wherein said stud further includes a lip for interlocking with said opening of said second member.

* * * * *